United States Patent [19]

Gruber

[11] Patent Number: 4,946,314

[45] Date of Patent: Aug. 7, 1990

[54] ROCK ANCHOR

[75] Inventor: Heinz Gruber, Seesen/Rhueden, Fed. Rep. of Germany

[73] Assignee: G. D. Anker GmbH, Seesen/Rhueden, Fed. Rep. of Germany

[21] Appl. No.: 390,188

[22] Filed: Aug. 4, 1989

Related U.S. Application Data

[63] Continuation of Ser. No. 211,235, May 9, 1988.

[30] Foreign Application Priority Data

Sep. 10, 1986 [DE] Fed. Rep. of Germany ..... 3630832
Jul. 22, 1987 [DE] Fed. Rep. of Germany ..... 3624165

[51] Int. Cl.[5] ..... E21D 20/00
[52] U.S. Cl. ..... 405/260; 405/259
[58] Field of Search ..... 405/259–261

[56] References Cited

U.S. PATENT DOCUMENTS 3,363,422 1/1968 Turzillo ..... 405/260
4,630,971 12/1986 Herbst et al. ..... 405/260

FOREIGN PATENT DOCUMENTS 2133593 7/1973 Fed. Rep. of Germany ..... 405/260
3400182 7/1985 Fed. Rep. of Germany ..... 405/260
790483 2/1958 United Kingdom ..... 405/260

*Primary Examiner*—Dennis L. Taylor
*Assistant Examiner*—Arlen L. Olsen
*Attorney, Agent, or Firm*—Michael J. Striker

[57] ABSTRACT

A rock anchor consists of a body member formed as a drilling-rod (1), which at one end carries a drill-head (2) and has externally over its whole length a coarse thread, for example an approximately round thread (3). The drill-head (2) is welded to the drilling-rod (1). The drilling-rod (1) has only at its forward region, that is adjacent the drill-head (2) peripheral bores (6), whereby the aforesaid forward region, from the drill-head (2), extend over a length of at most 20 cm. The bores (6) extend at an angle to the axis of the drilling-rod (1), namely, from inside to outside in a direction from the drill-head (2). This rock anchor serves simultaneously for making a drilling, whereby the tubular body member serves for the supply of the hydraulic fluid, which passes into the bore-hole via an hydraulic bore (5) in the drill-head (2) and the aforesaid peripheral bores (6) and passes back to the outside of the drilling-rod (1) with the drilling fines produced. After completion of the drilling a mortar suspension under pressure is injected via the aforementioned body member, which likewise flows via the bores (6), so that the borehole is gradually filled with the mortar base of the borehole. The rock anchor according to the invention has considerable structural simplicity and likewise is simple to handle, so that broken rock can readily be stabilized by means of it.

13 Claims, 3 Drawing Sheets

II 9,10
11
III
12
5
2
6
1
3
4

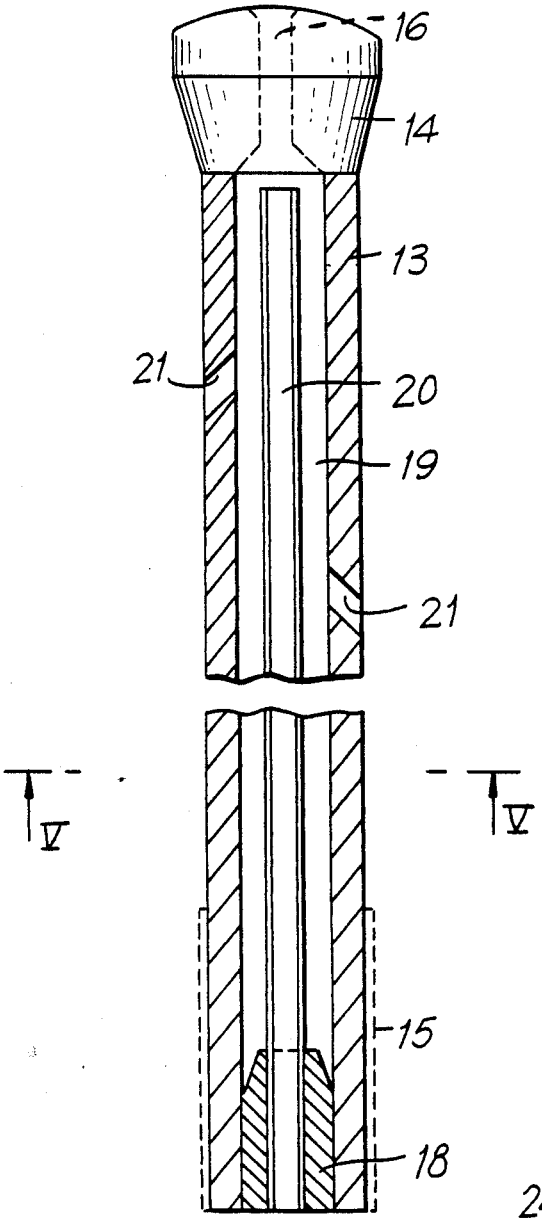
FIG. 4
FIG. 5
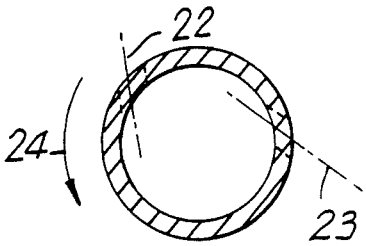

ROCK ANCHOR

This is a continuation, of application Ser. No. 211,235, filed May 9, 1988.

BACKGROUND OF THE INVENTION

The invention relates to a rock anchor.

As is known, when extending a cavity in a broken and difficultly-borable rock, the latter must be stabilised or solidified by inserting anchors. It is known in this connection to use so-called injection tube anchors. These consist generally of a strong-walled tube, one end of which is closed and also runs to a point and the other end carries a threaded part. The surface of the tube is provided with numerous openings. Such a tube anchor is inserted into existing boreholes whereby, on forcing in cement mortar which exudes through such openings, the space between the borehole and the tube anchor becomes filled. Since in this way the cement mortar also passes into the spaces in the rock surrounding the borehole, the surrounding rock is solidified on hardening, so that the tube anchor serves in known manner as a tie-rod. Since the tube anchor can be rammed directly into the rock only in exceptional cases, this process of stabilisation of a cavily presupposes the preliminary provision of a borehole.

The formation of boreholes, which can attain a depth of up to 12 m, therefore frequently involves difficulties in broken rock, since recovery of the tie-rods is problematical and consequently is often connected with their loss. The expenditure of time and cost arising in this way from the formation of the borehole is a considerable overhead in the construction of a tunnel, which is significant especially with borehole depths of more than 4 m, since in these cases the inserted tie-rods have to be extended. Furthermore, if the tie-rods have to be extended, the straightness of the borehole often cannot be ensured exactly with varying rock formations. The possibilities for error thus arising render difficult insertion of the rock anchor after formation of the borehole.

It is known to use drilling rods simultaneously as anchors, cement mortar being injected under pressure into the borehole, after insertion of the drilling-rod by way of the hydraulic bore in the drill-head. In these cases, spreading out of the cement mortar in the borehole is very limited, so that in practice only the tip of the drilling-rod is cemented into the surrounding rock, whereas the remainder of the drilling-rod has no connection with the rock. The deficiency in stabilisation of the rock which thus arises cannot be assessed in many cases.

From DE-PS No. 936, 082, a borer for dry borings to be used simultaneously as a rock anchor is known, whose drilling-rod is provided with a central longitudinal bore, from which transverse borings branch off and are distributed uniformly over its entire length. The axes of the borings extend from the aforementioned longitudinal bore at angles to the transverse section plane in the direction of the base of the borehole. The drilling-rod is provided on its outside with a screw-thread-shaped surface structure which is formed by a welded or soldered wire or the like, for example forged beads. The aforementioned transverse borings serve for the removal of the rock dust, which is produced during a drilling phase in the region of the drill-head and is removed via the central longitudinal bore. After completion of the boring, cement milk is injected into the borehole via these transverse bores, by which the surrounding rock is solidified and where, by means of the surface structure of the exterior of the drilling-rod, the bond between the hardened cement filling on the one hand and the drilling-rod on the other hand is improved. Should this known borer have to be used for the injection of cement mortar, this raises the problem that uniform filling of the borehole cannot be ensured sufficiently, because of the flow-resistance of the transverse bores in the direction towards the borehole outlet.

Thus the known drilling-rods used simultaneously as rock anchors have defects which concern the injection of the cement mortar into the borehole, particularly the uniform distribution of the mortar filling. However, the quality of the bonding action between the various rock or stone formations whose position is to be stabilised, achievable by the rock anchor, depends upon the latter.

SUMMARY OF THE INVENTION

It is therefore the purpose of the invention to conceive a rock anchor which, with simultaneous utility as a drilling-rod, also in a simple and economic manner enables ready mortaring with the rock surrounding the borehole, particularly a uniform distribution of mortar in the borehole. This problem is solved with a rock anchor according to the invention, which is provided with outlet openings merely in its forward region, i.e. adjacent the drill-head. These are the openings in the peripheral region of the drilling-rod on the one hand, as well as about the central hydraulic bore of the drill-head, on the other hand. This ensures that, during use of the article of the invention as a drilling-rod, not only does an acceptable cooling of the drill-head occur, but also a rapid removal of the drilling fines removed during the drilling, which pass out from the borehole at the outside of the drilling-rod according to the invention. Satisfactory removal of the drilling fines thus occurs, even if the central hydraulic bore of the drill-head has become blocked up at least partly for a time. Since the drill-head in general has a greater diameter than the rest of the drilling-rod, for return flow of the suspension containing the drilling fines, a sufficient annular space is thus made available in the borehole.

After forming the borehole, the article according to the invention is used as a rock anchor, by forcing anchorage mortar into the borehole through its inner space. This anchorage mortar mainly enters via the peripheral bores located in the front region of the rock anchor. The advantageous effects achieved by the arrangement of the bores in the forward region of the rock anchor according to the invention consist essentially in that the borehole is always filled with mortar starting from the base of the borehole—advancing in the direction towards the borehole outlet—which, during its return flow along the outside of the tie-rod, also fills the space in the surrounding rock located in the region of the borehole wall. The mortar must thus arrive at the outlets from the bores at such a pressure as is sufficient to overcome the flow resistance present in the return passageway along the outside of the drilling-rod. As the forward region of the drilling-rod, within which the bores are distributed in a uniform manner, a region is to be understood which extends substantially from the drill-head over a length of up to 20 cm. In this way, a mechanically very simple extension of the rock anchor also usable as a drilling-rod is given, which with longer borings can be extended in known manner through the interposition of extension pieces.

In accordance with a further feature of the present invention, the drill-head is formed as an axially short blade-like element, preferably non-detachably connected with the body member, and provided with cutting edges, projections or the like on its side which faces the base of the hydraulic bore. These features ensure, in a simple way, that during the drilling phase, by reason of the short axial extent of the drill-head, the flow resistance to the hydraulic liquid carrying the drilling fines arising during its return flow is kept small.

As, in this way, a continuous flow around the drill-head is ensured during the drilling process, this also contributes to an efficient cooling at the same time. The plate-like construction of the drill-head also means that the rock anchor is held in the borehole on injection.

In accordance with the invention, the drill-head can be provided with circumferential formations for improving the flow of an hydraulic medium passing out from the hydraulic bore. By these features, the flow characteristics in the region of the drill-head are further improved and also the possibilities of removal of the drilling fines and the heat which is also developed.

The total cross-section of all bores can correspond at least to the inner cross-section of the tubular body member. These features ensure that the flow velocity within the tubular body member in practice corresponds to that in the bores in the forward region of the drilling-rod. In this way, the pressure loss during the passage through the drilling-rod is kept small and thus the consumption of energy is very satisfactorily influenced both for the supply of hydraulic liquid and for the anchorage mortar. The transverse uniformity of the internal cross-section of the tubular body member can be maintained here either merely with the bores of the drilling-rod or basically with all the bores in the forward region thereof, that is including the central hydraulic bores of the drill-head.

The purpose indicated initially is solved in a rock anchor in accordance with the invention which also has the following features. The body member consists of a strong-walled tube provided in the peripheral region with bores, at one end of which a boring tool is provided and at another end a threaded section is provided, which serves as the coupling for a driving apparatus for the drilling process or coupling sleeves for extension rods. The tube provided inside the tubular body member at a distance from its inner walls is used for the supply of an hydraulic liquid, which is injected into the region of the drilling tool or the drill-head. This tube serves simultaneously for the supply of an anchorage mortar suspension, which must be injected under pressure into the rock space which defines the borehole. It is essential that the outlet opening of the tube is located at a small distance in front of the axial hydraulic bore of the drill-head. This has the consequence that, both during the drilling and also during injection of the mortar, the materials introduced first emerge via the hydraulic bore of the drill-head and fill the surrounding rock space. Since the tube is arranged in the body member at a spacing from the drill-head, a return flow of the mortar suspension occurs within the body member as soon as the space defining the head part of the borehole has been completely filled. This return flow of the mortar suspension has the consequence that, beginning with the bores arranged adjacent the drill-head in the surface of the body member, the mortar suspension then passes out laterally, until finally the whole space defined by the borehole is filled. The central idea of the invention is thus based on the fact that, in a first phase of the introduction of mortar, this is largely or exclusively injected into the region of the drilling tool for instance via the hydraulic bores, and that, in a second phase, the mortar suspension passes via the bores in the surface of the body member, beginning with the region adjacent the drill-head and continuing up to the threaded section. In this way, an acceptable and uniform bonding of the rock anchor to the surrounding rock is given. The outlet opening of the tube arranged within the body member must be so arranged and dimensioned spatially, because of the hydraulic bores present, that the mortar suspension passing out from the tube is mainly directed into the hydraulic bore. In this way, it is also ensured simultaneously that the hydraulic fluid in the tube supply also passes, as occurs with conventional drilling-rods, mainly via the hydraulic bores in the region of the drill-head, so that a cooling effect is exerted and simultaneously the drilling fines produced during the drilling process are removed and flow to the outside of the body member.

The tube can be sealingly held by a clamping member which is sealingly inserted into one end in the tubular body member. These features provide for an advantageous construction, so that the rearward part of the body member is tightly enclosed in any case.

The tube preferably can be made of an elastic material, namely a plastic material. These features have the advantage that, after the process of introduction of the anchorage mortar has ended, the tube functions in practice like a non-return valve, through which escape of the mortar from the body member is prevented. For this purpose, the tube can be made of a corresponding plastics material, though generally it could also be made in metal.

The total cross-section of the tube can have a size which is about 25–50% of the total cross-section of the inner space of the body member. These features have in practice proved to be especially advantageous.

The body member can be provided externally over its whole length with a relatively coarse thread, particularly a round thread. By these features, during the drilling, a certain conveying action of the suspension loaded with the drilling fines issuing from the borehole takes place, via the whole surface of the drilling-rod. Particularly if large particles are held in the suspension, in this way the formation of blockages is opposed. The preferably round thread also ensures, during use of the article of the invention as a rock anchor, an improvement in the bonding action between the hardened cement mortar on the one hand and the drilling-rod on the other hand. In any case, a relatively coarse thread is used, which should be made essentially by a non-cutting method, for instance, by rolling or the like, as regards the strength of the drilling-rod, by basing it upon a tubular body member.

The bores in the surface of the body member can extend at an angle to the axis of the body member as seen in an axial direction from inside to outside in a direction away from the drill-head. On the other hand, they can extend at an angle to a radial direction as seen in radial section, from inside to outside in a direction which is opposite to the direction of rotation of the drill head. These features bring the advantage that, during the drilling process, the bores made in the surface of the body member cannot become clogged with the drilling fines.

The invention is further illustrated in the following with reference to the embodiments shown in the drawings.

BRIEF DESCRIPTION OF THE DRAWING

FIG. 4—an axial section through another embodiment of the rock anchor according to the invention;

FIG. 5—a representation of a radial section in a plane V—V of FIG. 4.

DESCRIPTION OF PREFERRED EMBODIMENTS

Figure 1:
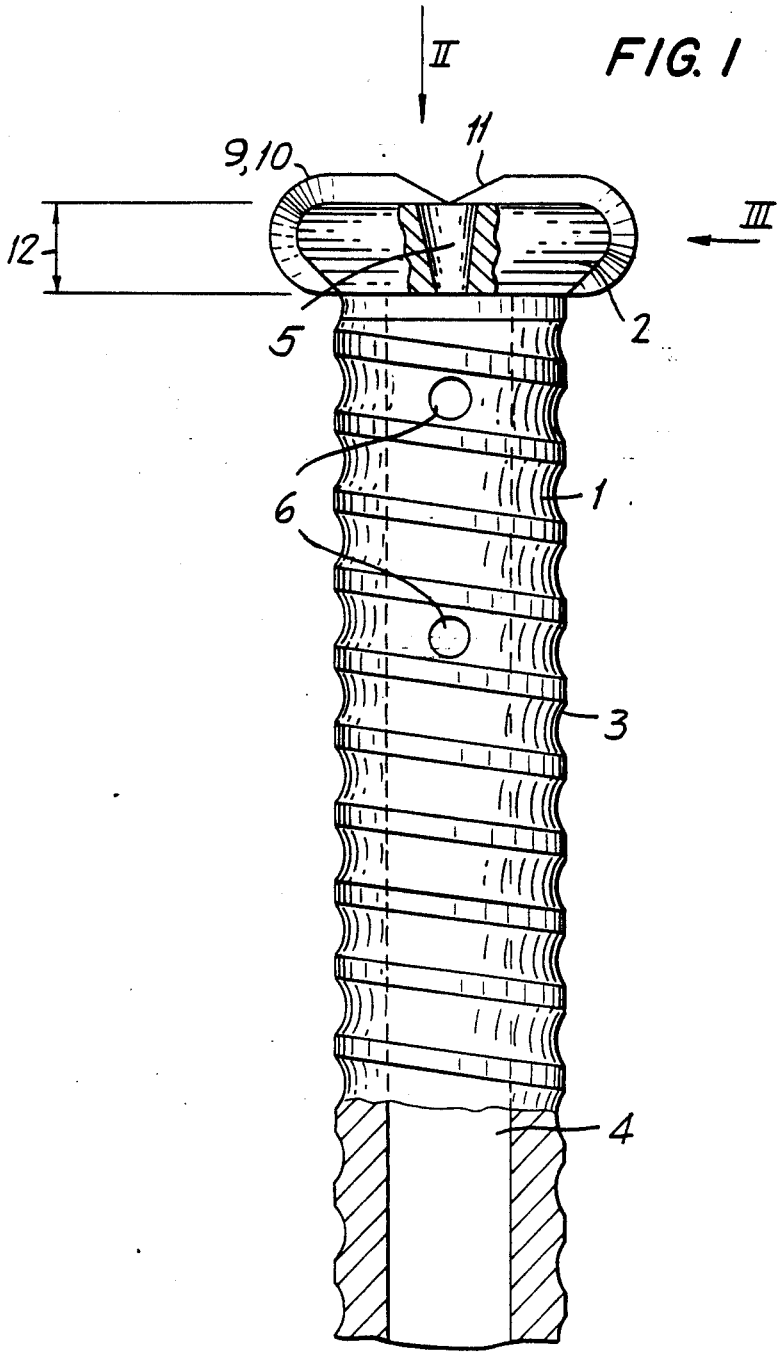
FIG. 1—a partial sectional side view of a rock anchor according to the invention.

In FIG. 1, a drilling-rod is indicated at 1, on one end of which a drill-head 2 is located. The drill-head 2 is welded to the drilling-rod 1.

The drilling-rod 1 is provided externally over its entire body with an approximately round screw thread 3, which is made from the tubular body member of the drilling-rod 1, preferably by a non-cutting shaping method, namely by rolling or flattening.

Within the drilling-rod 1 runs a central axial bore 4, which is extended within the drill-head 2 into a likewise axially-running hydraulic bore 5. The bore 4 has an internal diameter preferably of at least 15 mm. The drilling-rod 1 is provided peripherally, generally in its region adjacent the drill-head 2, with bores 6 extending transversely to the longitudinal axis, whose axes, extending from the internal space of the axial bore 4, run at an angle to the transverse section plane, namely in the direction from the drill-head 2. The bores 6 are uniformly distributed generally over the periphery of the drilling-rod 1, so that, by the afore-mentioned forward region of the drilling-rod, such a region is to be understood as starts from the drill-head 2 and extends preferably over a length of at the most 20 cm. The bores 6 as well as the hydraulic bore 5 are dimensioned so that the sum of their throughput cross-sections corresponds approximately to the throughput cross-section of the axial bore 4.

The round thread 3 serves in known manner for coupling up a drilling hammer or other driving device for the drilling-rod 1 and can be extended by the inter-position of corresponding sleeves, not illustrated in the drawing, namely using such extension drilling-rods as are externally likewise provided over their whole length with a screw thread corresponding to the round thread 3.

Figure 2:
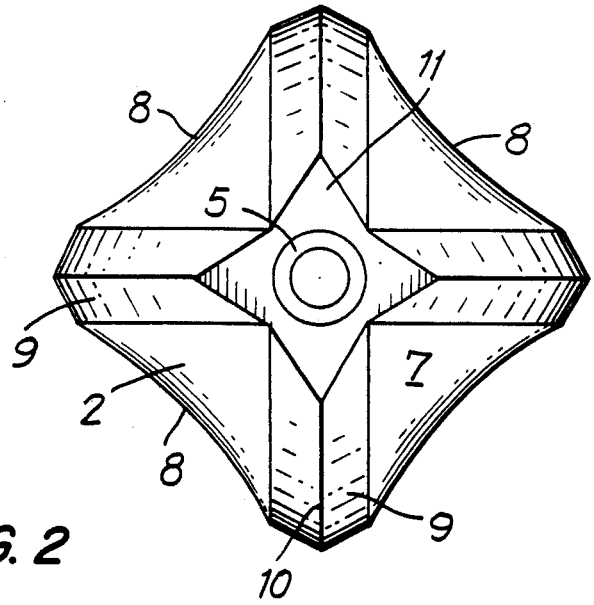
FIG. 2—a plan view of the rock anchor corresponding to arrow II of FIG. 1.
Figure 3:
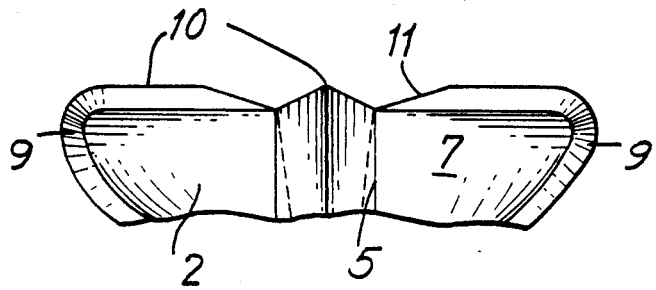
FIG. 3—a side view of the drill-head of the rock anchor according to arrow III of FIG. 1.

The drill-head 2 shown on an enlarged scale in different view in FIGS. 2 and 3 consists of a plate-like body member 7, which has an approximately quadratic form in the embodiment shown here, the sides of which are provided with arcuate formations 8. These formations 8 are generally so dimensioned that their deepest points touch an outer circle surrounding the round thread 3. The importance of this construction is explained in more detail in the following.

The body member 7 carries on its exterior, that is on the side facing the base of the bore-hole, a star-shaped arrangement of prism-like projections 9, whose edges 10 extend in direction to the corners of the square body member 7 and form cutting edges for the drilling process. These projections 9 are spaced around the lateral limiting edges of the body member and end at a small spacing from the position at which the drilling-rod is welded. The cutting edges defined in this way are effective not only in the front region but also in the peripheral region. The edges 10 end in the central region of the body member in inclined surfaces 11, which are inclined in the direction toward the discharge opening of the hydraulic bore 5.

The drill-head 2, particularly the body member 7, is made as short as possible in its axial dimensions, that is extending in the direction of the arrows 12.

The device described in connection with FIGS. 1 to 3 forms a rock anchor which is used simultaneously as a drilling-rod. Its practical handling is briefly described in the following:

This device is first used as a drilling-rod, that is a driving apparatus is coupled to the round thread 3, whereby during boring a hydraulic liquid is pumped via the axial bore 4. Via the liquid stream emerging from the hydraulic bore 5, the drilling fines formed in the region of the drill-head 2 are removed and are transported to the outside of the drilling-rod 1 and pass from the bore. Since the drill-head 2 has a greater external diameter than the drilling-rod 1 because it is provided with the peripheral formations 8, easy discharge of the drilling fines produced takes place in the region behind the drill-head 2. For satisfactory flow, this suspension containing the drilling fines also passes over the small axial length of the drill-head 2. By the above-mentioned cross-sectional dimensioning of the bores 6, in conjunction with the hydraulic bore 5, a satisfactory flow of the hydraulic material is also ensured. Since the axes of the bores 6 are directed sharply rearwardly, that is from the drill-head, the flow of hydraulic material favors removal of the drilling fines in the direction towards the borehole aperture. By the round thread 3 extending over the whole length of the drilling-rod 1, an advancing action of the drilling fines is also given, so that particularly the larger particles are removed satisfactorily and the formation of blockages does not arise.

Depending upon the length of the borehole, several drilling-rods are coupled together, which likewise have a round thread on their whole outer length. After completing the drilling, cement mortar is now injected via the axial bore 4 which mainly enters via the peripheral bores 6 arranged in the front region, that is adjacent the drill-head 2, so that the bore-hole—beginning at the base of the bore-hole—is filled by the mortar "flowing backwards" through the drilling-rod 1 at the outside up to the bore-hole outlet, whereby simultaneously, because of the mortar pressure arising at the rearward surface of the drill-head 2, i.e. facing the bore-hole base, the rock anchor is held in the bore-hole. The mortar thus enters the hollow spaces in the rock present in the region of the bore-hole wall, which is solidified in this way. By the round thread 3, in known manner, the bond between the rock anchor according to the invention on the one hand and the hardened mortar on the other hand is improved.

The drilling-rod of a further embodiment is indicated at 13 in FIG. 3, on one end of which a drill-head 14 is disposed. The drill-head 14 can be welded to the drilling-rod 13, screwed on or pressed on directly.

The end of the drilling-rod 13 away from the drill-head 14 is provided externally with a coarse left-handed round screw thread 15, by which in known manner a drilling hammer or other driving device can be coupled to the drilling-rod 13. By the inter-position of corresponding sleeves, not shown in the drawing, by way of the round thread 15, further drilling-rods 13 can be connected, for the purposes of extension.

The drill-head 14 is provided in known manner with a central bore 16, which serves for the supply of hydraulic fluid. The bore 16 passes from the interior of the drill-head 14 via a funnel-shaped widening 17 into the drilling-rod 13.

A clamping member is indicated at 18, which is inserted, for instance screw-threaded, into the drilling-rod 13. The clamping member 18, made for instance of metal, serves for fixing a tube 20 extending coaxially to the interior space 19 in the drilling-rod 18, whose outlet opening is arranged in the region of the funnel-like widening 17 of the drill-head 14. The tube 20 can be made of a rigid plastic material, but can also consist of metal and is so dimensioned that it occupies about a quarter to a half of the cross-sectional area of the interior of the drilling-rod 13. The tube 20 is inserted sealingly into the clamping member 18, so that the connection between the clamping member 18 and the interior wall of the drilling-rod 13 can likewise be made in a sealed manner. The open cross-section of the tube 20 is smaller than that of the bore 16.

Bores in the wall of the drilling-rod 13 are indicated at 21, whose axes run at an angle to the longitudinal axis of the drilling-rod 13, namely the bores 21 extend to the rearward end of the drilling-rod 13, that is from the drill-head 14. The axes of the bores 21, in a cross-sectional plane of the drilling-rod 13, moreover are arranged to be inclined at an angle to the radial direction namely in the opposite direction to the direction of rotation.

The last-mentioned feature is illustrated in FIG. 5, in which the projections of the axes of two of the bores 21 are indicated at 22 and 23 (FIG. 4) and, at 24, the direction of rotation of the drilling-rod 13 in the drilling process. The device illustrated in FIGS. 4 and 5 represents a drilling-rod with drill-head and simultaneously a rock anchor. Its practical handling is briefly explained as follows:

The device is first used as a drilling-rod, that is, by means of the round thread 15, a drilling hammer or other driving device is coupled to it, whereby, during drilling, hydraulic liquid is pumped in via the central tube 20, which collects the drilling fines (rock dust) produced there via the bore 16 in the drill-head 14 and discharges them outside the drilling-rod 13 from the bore-hole outlet. The mouth of the tube 20 in the region of the drill-head 14 is so arranged that the hydraulic liquid emerging at high pressure is forced directly through the drill-head and only a small fraction remains in the interior space 19. This directing of the hydraulic liquid is achieved by a small spacing of the outlet of the tube 20 from the bore 16 on the one hand and by the already-described cross-sectional dimensions of the tube 20 on the one hand and the bore 16 on the other. Because of the above-described angular orientations of the bores 21, both in the radial and in the axial planes, this prevents drilling fines becoming solidified in the bores 21 during the drilling process and, if required, they are forced into the interior space 19.

After the preparation of the bore-hole, in which if required several drilling-rods are coupled together by means of the round thread 15 and corresponding sleeves, the above-mentioned driving device and/or drilling hammer is detached from the round threads by reversing its direction of rotation and then, after screwing on a corresponding coupling member, an anchorage mortar suspension is injected via the tube 20 at high pressure into the drilling-rod 13. This suspension enters the region of the widening 17 from the tube 20 and passes via the bore 16 of the drill-head 14 into the surrounding rock space, which then becomes completely filled. As soon as this filling step has been completed, so that a substantial pressure increase is produced in the region of the drill-head, the suspension flows in the opposite direction into the annular interior space 19 surrounding the tube 20 and then passes via the bores 21 beginning with the first as seen in the axial direction, that is the bores 21 nearest to the drill-head 14. In the subsequent period in this way, in which the suspension flows backwards in the inner space, the whole of the rock space surrounding the drilling-rod 13 is continuously filled, so that the drilling-rod is finally firmly embedded over its whole length in the afore-mentioned suspension. After the further supply of the suspension has been provided, when the tube 20 is made of an elastic material, e.g. a plastics material, this acts as a non-return valve, by which rearward flow of the suspension is prevented. The round thread 15 now projecting from the bore-hole can then be tightened against the rock with an anchor plate, not shown in the drawing, and a screw-threaded nut, after hardening of the mortar.

I claim:

1. Rock anchor, consisting of a tubular body member having a threaded section at least at one end and, at the other end, a drill-head (2, 14, 25) and provided with bores (6, 21), characterized in that the bores (6) are arranged exclusively in a region adjacent the drill-head (2) and that the drill-head (2) is provided in known manner with an axial hydraulic bore (5), and the bores (6, 21) in the surface of the body member, seen in radial section, run at an angle to a radial direction and extend from inside to outside in the opposite direction to the direction of rotation of the drill-head (2, 14, 25).

2. Rock anchor according to claim 1, characterised in that the drill-head (2,25) is formed as an axially short plate-like component preferably non-detachably in connection with the body member and provided, on its side facing the base of the bore-hole, with cutting edges (10), projections (28) or the like.

3. Rock anchor according to claim 2, characterised in that the drill-head (2) is provided with circumferential formations (8) for improving the flow of an hydraulic medium passing out from the hydraulic bore (5).

4. Rock anchor according to claim 1, characterised in that the total cross-section of all the bores (6) corresponds at least to the inner cross-section of the tubular body member.

5. Rock anchor according to claim 1, characterised in that the body member is provided externally over its whole length with a relatively coarse thread, particularly a round thread (3,15).

6. Rock anchor according to claim 1, characterised in that the bores (6,21) in the surface of the body member, seen in axial section, run at an angle to the axis of the body member and extend from inside to outside from the drill head (2,14,25).

7. Rock anchor, consisting of a tubular body member having a threaded section at least at one end and, at the other end, with a drill-head (2, 14, 25) and provided with bores (6, 21), characterized in that a tube (20) is arranged within the body member at a spacing from its inner walls, whose outlet opening is located a small distance before an axial hydraulic bore (16) of the drill-head (14) and that the tube (20) is sealingly connected with the body member, and the flow cross-section of the tube (20) is made smaller than that of the hydraulic bore (16).

8. Rock anchor according to claim 7, characterised in that the tube (20) is sealingly held by means of a clamping member (18) sealingly inserted into one end in the tubular body member.

9. Rock anchor according to claim 7, characterised in that the tube (20) is preferably made of an elastic material, namely a plastics material.

10. Rock anchor according to claim 7, characterised in that the tube (20) is preferably made of an elastic material, namely a plastics material.

11. Rock anchor according to claim 7, characterised in that the body member is provided externally over its whole length with a relatively coarse thread, particularly a round thread (3,15).

12. Rock anchor according to claim 7, characterised in that the bores (6,21) in the surface of the body member, seen in axial section, run at an angle to the axis of the body member and extend from inside to outside from the drill head (2,14,25).

13. Rock anchor, consisting of a tubular body member having a threaded section at least at one end and, at the other end, with a drill-head (2, 14, 25) and provided with bores (6, 21), characterized in that a tube (20) is arranged within the body member at a spacing from its inner walls, whose outlet opening is located a small distance before an axial hydraulic bore (16) of the drill-head (14) and that the tube (20) is sealingly connected with the body member, and the total cross-section of the tube (20) has a size about 25%–50% of the total cross-section of the inner space (19) of the body member.

* * * * *

UNITED STATES PATENT AND TRADEMARK OFFICE

CERTIFICATE OF CORRECTION

PATENT NO. : 4,946,314

DATED : August 7, 1990

INVENTOR(S) : Heinz Gruber

It is certified that error appears in the above-identified patent and that said Letters Patent is hereby corrected as shown below:

On the title page:

The priority number "3624165" for Claims priority, application Fed. Rep. of Germany July 22, 1987, should read --3724165--.

Signed and Sealed this

Fourth Day of February, 1992

*Attest:*

HARRY F. MANBECK, JR.

*Attesting Officer*

*Commissioner of Patents and Trademarks*